US006182547B1

(12) United States Patent
Bond

(10) Patent No.: US 6,182,547 B1
(45) Date of Patent: Feb. 6, 2001

(54) UNLOADER CONVEYOR FOR A BLANKING DIE

(76) Inventor: Irvin D. Bond, 10270 Allen Rd., Clarkston, MI (US) 48348

( * ) Notice: Under 35 U.S.C. 154(b), the term of this patent shall be extended for 0 days.

(21) Appl. No.: 09/263,573

(22) Filed: Mar. 8, 1999

(51) Int. Cl.[7] ..... B26D 7/06; B21D 45/00

(52) U.S. Cl. ..... 83/112; 83/82; 83/155; 72/426; 198/679

(58) Field of Search ..... 83/82, 112, 134, 83/136, 140, 150, 155, 81, 100; 198/375, 377.01, 377.05, 377.09, 679, 690.1; 72/426, 361

(56) References Cited

U.S. PATENT DOCUMENTS 1,809,076 * 6/1931 Shinn et al. ..... 198/679
2,600,475 * 6/1952 Buccicone ..... 198/679
2,867,185 * 1/1959 Hayward ..... 72/426
2,976,753 * 3/1961 Fowler et al. ..... 83/82
3,795,301 * 3/1974 Sugitani ..... 198/690.1 X
4,411,724 * 10/1983 Ito et al. ..... 198/690.1 X
4,912,959 4/1990 Bond ..... 72/426

* cited by examiner

*Primary Examiner*—Boyer Ashley
(74) *Attorney, Agent, or Firm*—Charles W. Chandler

(57) ABSTRACT

A steel blank can be removed from the space between a lower stationary die and an upper movable die by employing a belt conveyor in a cavity in the upper die. The frame for the conveyor belt mounts an array of permanent magnets that exert a magnetic pick-up force through the lower run of the belt into the steel blank. The conveyor frame is floatably suspended to follow the upper die, while being downwardly deflected by the action of a stripper pad carried by the upper die, such that the blank is dislodged from the upper die and then transported out of the space between the two dies.

9 Claims, 4 Drawing Sheets

UNLOADER CONVEYOR FOR A BLANKING DIE

BACKGROUND AND SUMMARY OF THE INVENTION

This invention relates to a belt conveyor, and particularly to a belt conveyor usable for removing a blank formed in a blanking die.

U.S. Pat. No. 4,912,959, issued to me on Apr. 3, 1990, discloses a belt conveyor extending into the opening between a vertically-movable upper die and a stationary die for removing a blank formed out of a steel sheet during the downstroke of the upper die. The upper die is equipped with an array of suction cups that lift the steel blank into engagement with the lower run of the belt conveyor. An electromagnet means located above the lower run of the belt conveyor holds the steel blank against the belt lower surface as the belt moves the blank out of the opening between the upper and lower dies. When the blank is approximately half way out of the opening between the upper and lower dies, a permanent magnet means takes over from the electromagnet means to hold the steel blank against the belt lower surface until the steel blank is transferred onto an external conveyor.

The present invention relates to an improvement on the belt conveyor disclosed in my U. S. Pat. No. 4,912,959. In the present invention the suction cups and electromagnet means are replaced with a permanent magnet means, to reduce the initial equipment cost and subsequent maintenance expense. The belt conveyor means is mounted for vertical synchronized motion with the upper die, so that while the upper die is cutting through the steel sheet (to form the steel blank), the permanent magnet means comes into close proximity to the steel blank. As the upper die begins its upstroke, the permanent magnet means lifts the steel blank into facial engagement with the lower surface of the conveyor belt.

When the lower run of the conveyor belt is spaced a suitable distance above the lower die, the motor for the conveyor is energized to enable the conveyor to transport the steel blank out of the opening between the upper and lower dies. During this operation, the permanent magnet means hold the steel blank in facial engagement with the lower run of the conveyor belt.

The invention is advantageous in that the initial equipment cost is relatively modest. In addition, maintenance costs are somewhat decreased due to the overall design simplicity of the equipment.

Specific features of the invention will be apparent from the attached drawings and description of a preferred embodiment of the invention.

DESCRIPTION OF A PREFERRED EMBODIMENT OF THE INVENTION

Figure 5:
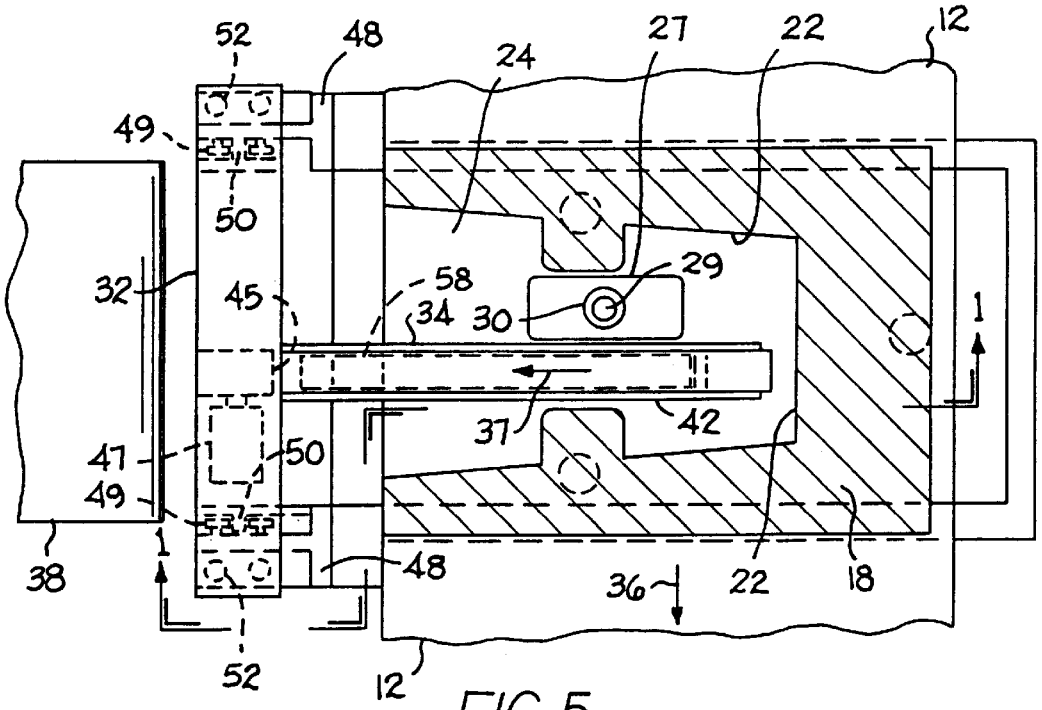
FIG. 5 is a sectional view taken essentially on line 5—5 in FIG. 1.

The drawings show a blanking die mechanism 10 adapted to operate on a steel sheet 12, to form a steel blank 14. The die mechanism comprises a stationary lower die 16 and a vertically-movable upper die 18. The upper die moves vertically a total distance of twelve inches in a continuous harmonic motion. The stationary lower die has side surfaces 20 that are complementary to side surfaces 22 of the upper die, so that when the upper die is powered downwardly to the FIG. 3 position, a steel blank having the shape of the lower die is formed by the cutting action of the upper die. In FIG. 5, the plan dimension of the blank is represented by numeral 24. The left edge of the blank coincides with the left edge of steel sheet 12; i.e. the blank extends from the left edge of sheet 12 to a point near the right edge of the sheet.

During the upstroke of upper die 18, the steel blank tends to frictionally adhere to side surfaces 22 of the die. Accordingly, a stripper mechanism is provided for dislodging the blank from die 18. As shown, the stripper mechanism comprises a pad 27 connected to a keeper rod 29; a coil spring 30 encircles rod 29 to provide a downward biasing force on pad 27, whereby the blank is dislodged downwardly out of die 18 during the die upstroke.

The present invention is more particularly concerned with a conveyor mechanism for removing the steel blank from the space between dies 16 and 18 after the blank has been dislodged from die 18. The conveyor comprises a T-shaped frame 32 (as viewed in FIG. 5) and a powered conveyor belt 34 supported on the frame for orbital motion at right angles to the feed direction of steel sheet 12. In FIG. 5, the feed direction of sheet 12 is indicated by arrow 36, whereas the movement direction of conveyor belt 34 is indicated by arrow 37. The conveyor belt is operable to deposit the steel blank onto an external conveyor 38.

Conveyor frame 32 comprises an external frame structure vertically slidably supported on the lower die assembly, and an internal frame structure 42 extending from structure 32 into the space between dies 16 and 18. Conveyor belt 34 is trained around an idler roller 43 mounted on the outboard end of frame structure 42, and a drive roller 45 suitable supported in external frame structure 32. An electric motor 47 is located within frame 32 for driving roller 45 and hence conveyor belt 34. A belt tension device (not shown) can be associated with driven roller 43 for maintaining a desired belt tension. The belt is preferably a smooth-surfaced belt formed of a flexible plastic material, or other flexible material that is non-magnetic.

The lower die assembly is equipped with two laterally-spaced brackets 48 for slidably supporting frame 32. Guide rollers 49 on brackets 48 engage web walls 50 on conveyor frame 32, whereby the conveyor frame is floatably, slidably supported for vertical movement. Two sets of coil springs 52 encircle rods 54 carried by frame 32, to bias it upwardly to the FIG. 1 position. Nuts 53 threaded onto the rods limit upward movement of the frame. The rods extend above frame 32, and have internal shoulders 55.

Figure 1:
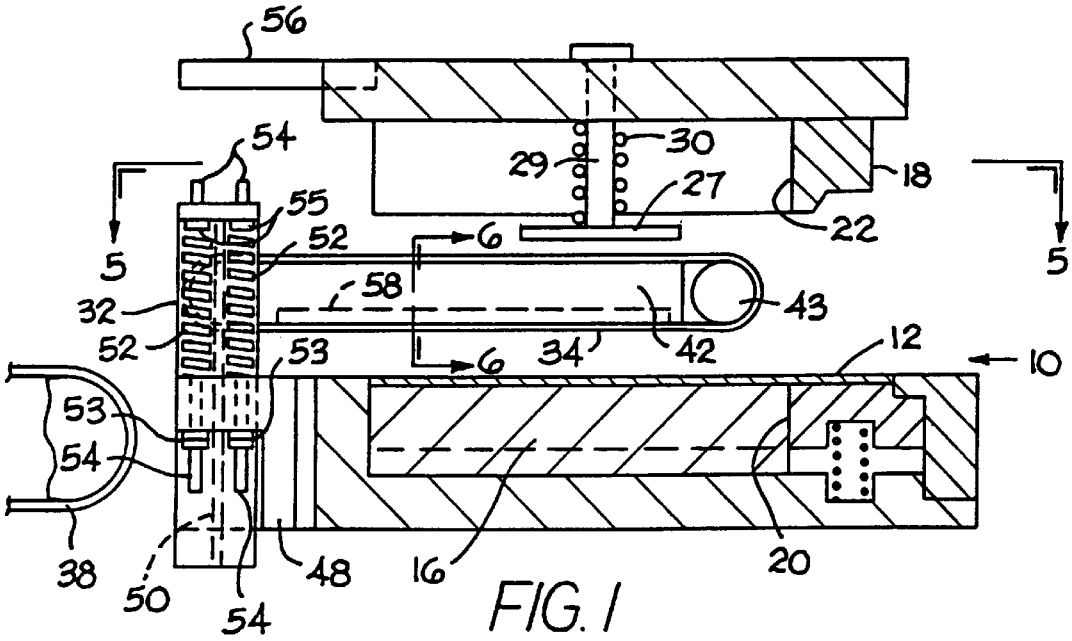
FIG. 1 is a sectional view taken through a blanking die mechanism equippped with a conveyor constructed according to the invention. The upper blanking die is shown at the upper limit of its motion that is commonly referred to as the die open position, for receiving the blank.

The upper die assembly carries an arm structure 56 that is vertically aligned with external frame structure 32 so that when upper die 18 is powered downwardly from the FIG. 1 position, arm structure 56 pushes rods 54 down until their upper ends are flush with the surface of frame 32 to compress springs 52. Further, downward motion of arm structure 56 pushes the rods and frame 32 downwardly. During the upstroke of die 18, coil springs 52 raise the conveyor mechanism to the FIG. 1 position (controlled by adjustment nuts 53).

Figure 7:
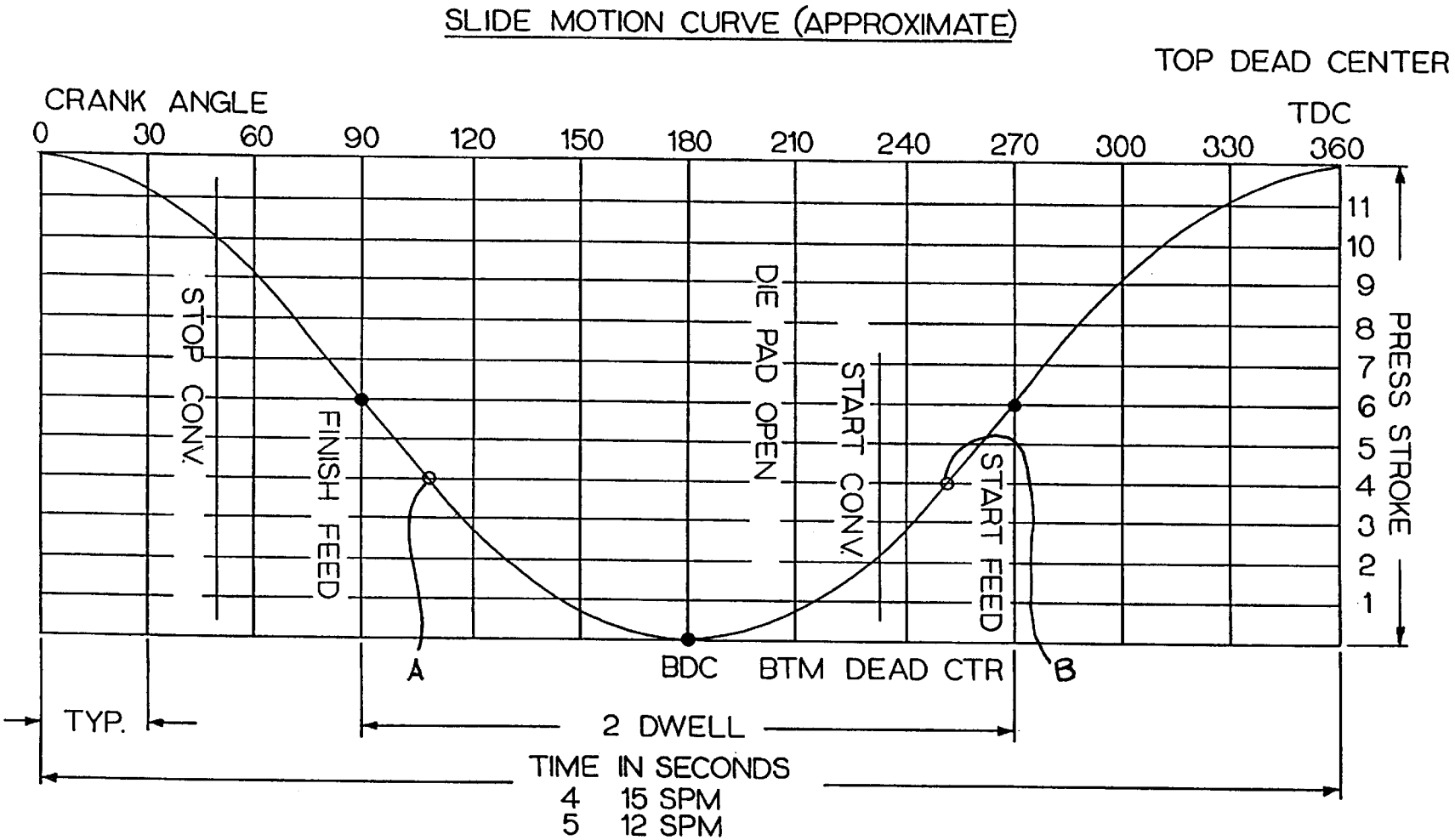
FIG. 7 is a slide motion curve of a typical embodiment of the invention.

In summary, the driving or left end of the belt as viewed in FIG. 1, moves horizontally (beyond points A and B), see FIG. 7, and then is stopped when positioned over blank 14. The conveyor motor is then de-energized. While the belt is in a static position, within points A and B, it is lowered and raised to raise the blank from the lower die. The motor is then energized to horizontally remove the blank from the press, in a timed sequence noted in FIG. 7.

Figure 6:
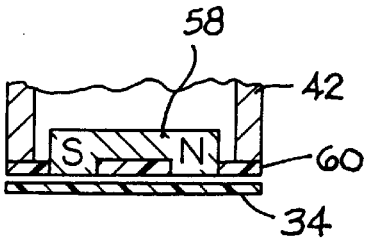
FIG. 6 is a fragmentary sectional view taken on line 6—6 in FIG. 1.

As an important feature of the invention, the conveyor mechanism includes an array of permanent magnets 58 within frame structure 42. As viewed in FIG. 1, the permanent magnets occupy substantially the entire space between drive roller 45 and driven roller 43. FIG. 6 shows one form that each individual magnet can take. Each magnet is mounted on the lower wall 60 of frame structure 42 so that the pole surfaces of the magnet are substantially flush with the undersurface of wall 60. Suitable holes are formed in wall 60 to accommodate the pole pieces. A large number of magnets are closely spaced along wall 60 to span substantially the entire space between rollers 43 and 45.

Figure 3:
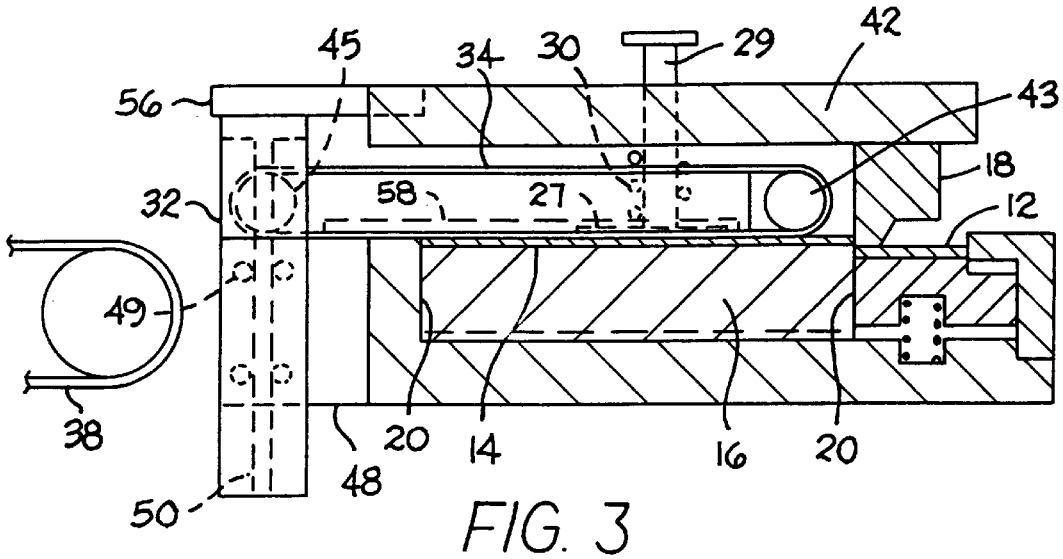
FIG. 3 is taken in the same direction as FIGS. 1 and 2, but with the upper die at the completion of the cutting action on the steel sheet, that is, the full down position. The blank formed by the cutting action is resting on the stationary lower die.

When conveyor belt 34 is in the FIG. 3 position, magnets 58 are sufficiently close to steel blank 14 to support the weight of the blank. When die 18 is raised on its upstroke, the belt conveyor follows die 18 upwardly to lift the steel blank 14 away from lower die 16. Later, drive motor 47 (FIG. 5) is energized to operate the conveyor belt and transport the steel blank out of the space between dies 16 and 18, and onto external conveyor 38.

Figure 2:
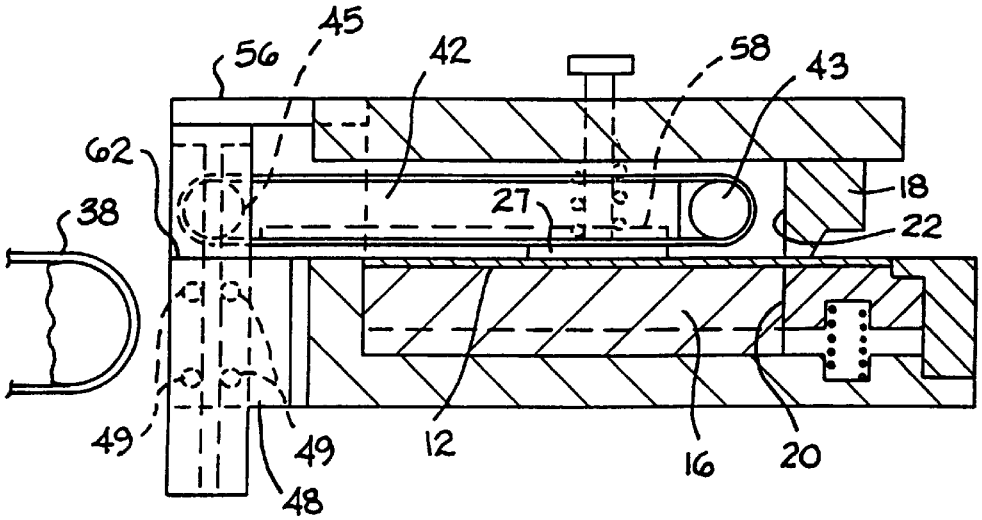
FIG. 2 is taken in the same direction as FIG. 1, but with the upper die moving downwardly to begin a cutting action on a steel sheet positioned on the lower, stationary blanking die.

To illustrate a representative cycle, the components start from the FIG. 1 die open position, with steel sheet 12 indexed to a stationary condition on lower die 16. Conveyor motor 47 is de-energized (stopped). Upper die 18 is powered downwardly through the FIG. 2 position to the position depicted in FIG. 3. During this phase of the down stroke, arm structure 56 pushes rods 54 down 35 mm. Frame 32 then is moved downwardly with the rods to the FIG. 3 position until conveyor frame 32 rests on lower, stationary frame 16 at 62. (FIG. 2) Gap D, FIG. 8, between blank 12 and belt 34 is maintained.

During the press up stroke, die pad 27 rests on the blank until the upper die shoe 18 contacts the head of keeper rod 29 and lifts pad 27. Blank 12 then rises with pad 27 until the magnetic blank is attached to the conveyor belt. At this point, shoulders 55 on rods 54 raise the conveyor assembly 32 to the open position until limited by nuts 53. Short springs, not shown, can be installed around nuts 53 to act as dampers. At the FIG. 2 condition, stripper pad 27 begins to retract upwardly relative to the cutting plane of die 18 so that spring 30 starts to compress.

Figure 4:
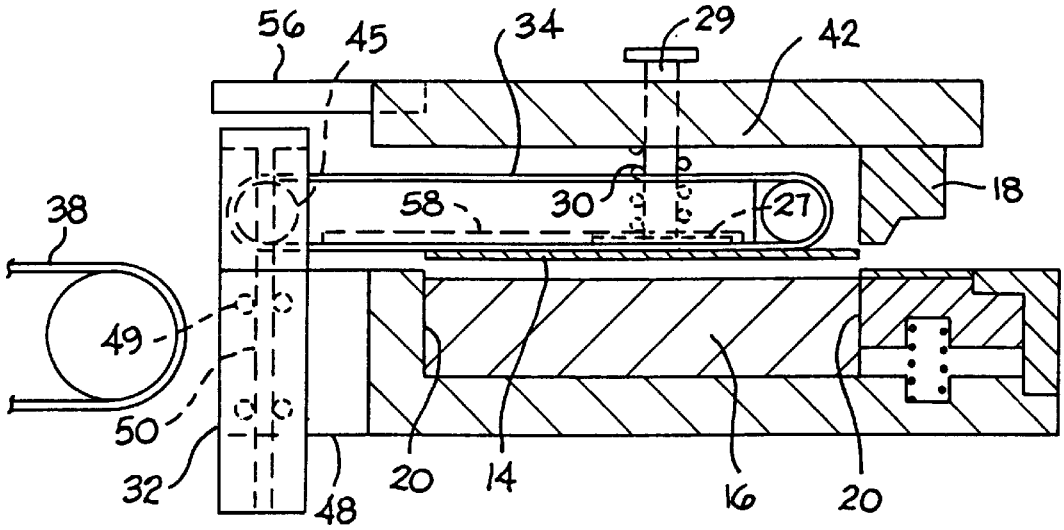
FIG. 4 is taken in the same direction as FIGS. 1, 2, and 3, but with the upper die on the upstroke. The conveyor belt is spaced above the lower stationary die.

When the FIG. 3 position is reached, there is sufficient compression in spring 30 that pad 27 strips steel blank 14 from die 18 during the initial stage of the die 18 upstroke. FIG. 4 shows the blank dislodged from die 18 by the action of stripper pad 27. At this time, frame structure 42 is slightly separated from steel blank 14, which is held down by pad 27.

The lifting action of springs 52 is somewhat delayed by spring 30 so that pad 27 is able to strip the steel blank 14 from die 18 and also move the belt conveyor frame downwardly relative to die 18. At or before die 18 reaches the FIG. 1 position (on the upstroke), motor 47 is energized to operate the conveyor belt 34 in the clockwise direction; i.e. the upper run of the belt moves to the right and the lower run of the belt moves to the left. Steel blank 14 is transported out of the space between dies 16 and 18 onto the external conveyor 38. During the transport period, the permanent magnet means 58 retain the steel blank 14 in facial engagement with the undersurface of the belt lower run. The length of magnet means 58 is sufficient so that the steel blank is suspended on the belt lower run until a substantial portion of the blank is located above (or on) conveyor 38.

Figure 8:
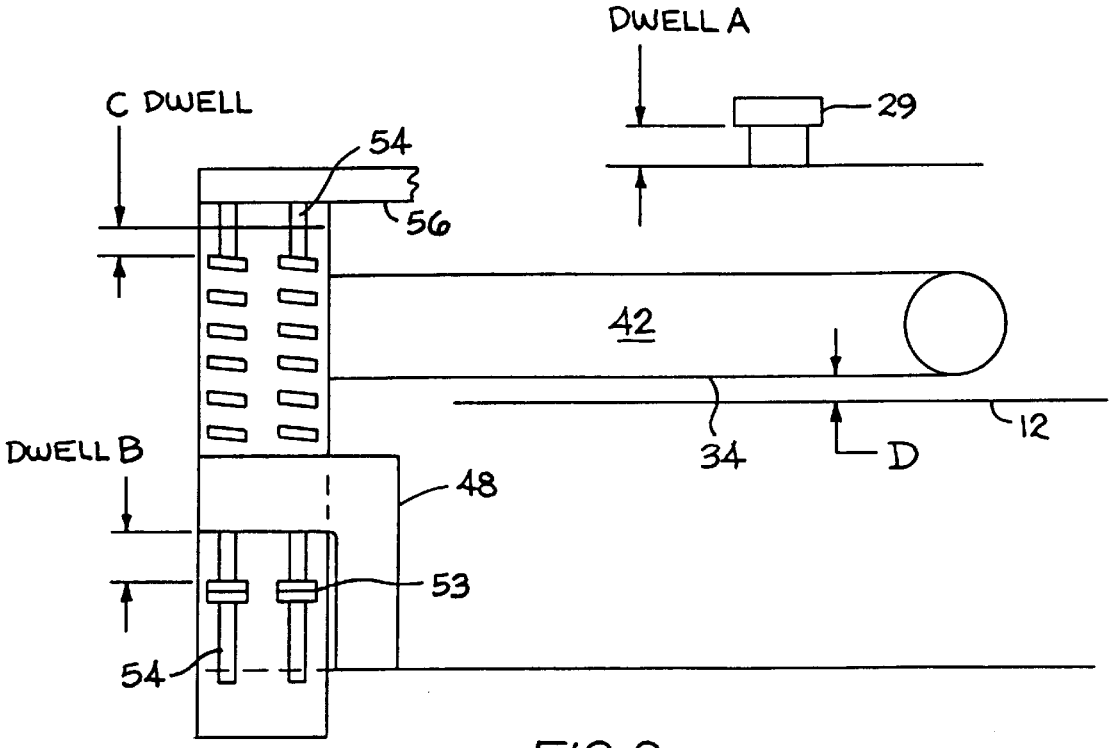
FIG. 8 is a schematic showing the relationship between the moving components.

Referring to FIG. 8, dwell B, the total vertical travel of rods 54, equals C, the vertical travel of the rods before the conveyor is lowered plus the vertical travel of the conveyor. Dwell C equals dwell A plus dwell D the total vertical conveyor travel equals dwell B minus dwell C. A dwell equals pad 27 dwell cutting action plus initial pre-compression.

The belt conveyor mechanism is advantageous in that permanent means 58 is relatively simple and effective, without being unduly costly or subject to frequent maintenance. Electromagnets could be used, but for most anticipated loads, permanent magnets are sufficient and preferred.

Having described my invention, I claim:

1. In a blanking die mechanism, the improvement comprising:

a stationary lower die;

a vertically movable upper die defining a work space with the lower die for horizontally passing a steel sheet to and from a cutting position on the lower die;

the upper die being vertically movable in a cutting motion toward a lower position adjacent said cutting position, and toward an upper position spaced above said lower position;

a conveyor means located in the work space for removing a blank from said cutting position, said conveyor means being vertically movable with respect to the upper die and including a conveyor belt having a horizontally movable lower run, and magnet means overlying said lower run; and means for connecting the conveyor means to said upper die such that as the upper die is being lowered during a cutting motion, the magnet means and the conveyor belt lower run are shifted in close proximity to the steel blank to raise the steel blank into facial engagement with the lower run of the conveyor belt as the upper die is being raised toward said upper position.

2. The improvement of claim 1, wherein the lower run of the conveyor belt is movable horizontally to transport the steel sheet from the space between the upper and lower dies only when said lower run is spaced a significant distance above the steel sheet.

3. The improvement of claim 1, wherein said magnet means comprises an array of permanent magnets.

4. The improvement of claim 1, wherein said conveyor means comprises a frame means that includes an exterior frame structure located outside the space between the upper and lower dies, and an interior frame structure extending from said exterior frame structure into the space between the upper and lower dies; said conveyor belt being trained around a drive roller located within said exterior frame structure and a driven roller located within said interior frame structure a substantial distance from said drive roller; said interior frame structure comprising a flat lower wall spanning between the drive and driven rollers immediately above the lower run of said conveyor belt; said magnet means comprising an array of permanent magnets closely spaced along the length of said flat lower wall.

5. The improvement of claim 1, wherein said conveyor means comprises a vertically shiftable frame means slidably supported on the lower die, and an arm structure extending from the upper die in vertical alignment with said frame means, whereby the upper die shifts said frame means downwardly during a die downstroke.

6. The improvement of claim 5, and further comprising a guide structure carried by the lower die for slidably supporting said shiftable frame means, and a spring means associated with said guide structure for exerting an upward bias on said frame means, whereby said frame means follows the upper die on a die upstroke.

7. The improvement of claim 1, wherein said conveyor means comprises an elongated frame structure, a drive roller and a driven roller supported on said frame structure; said frame structure having an elongated lower flat wall spanning between the drive roller and the driven roller; said conveyor belt being trained around said drive and driven rollers; the lower run of said conveyor belt running along an undersurface of said lower flat wall; said magnet means being supported on said lower flat wall.

8. The improvement of claim 7, wherein said magnet means comprises an array of permanent magnets regularly spaced along the length of said lower flat wall.

9. The improvement of claim 7, wherein said magnet means occupies substantially an entire length of said lower flat wall.

* * * * *